US009671189B2

(12) United States Patent
McPherson

(10) Patent No.: US 9,671,189 B2
(45) Date of Patent: Jun. 6, 2017

(54) HIGH LET-OFF CROSSBOW

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 14/616,322

(22) Filed: Feb. 6, 2015

(65) Prior Publication Data

US 2015/0233664 A1 Aug. 20, 2015

Related U.S. Application Data

(60) Provisional application No. 61/936,696, filed on Feb. 6, 2014, provisional application No. 62/085,208, filed on Nov. 26, 2014.

(51) Int. Cl.
*F41B 5/12* (2006.01)

(52) U.S. Cl.
CPC ..... *F41B 5/123* (2013.01)

(58) Field of Classification Search
CPC ..... F41B 5/10; F41B 5/12; F41B 5/123
See application file for complete search history.

(56) References Cited

U.S. PATENT DOCUMENTS 4,976,250 A * 12/1990 Jeffrey ..... F41B 5/10 124/25
6,688,295 B1 2/2004 Miller
6,990,970 B1 1/2006 Darlington
6,994,079 B1 2/2006 Darlington
7,305,979 B1 12/2007 Yehle
7,363,921 B2 4/2008 Kempf
7,832,386 B2 11/2010 Bednar et al.
7,836,871 B2 11/2010 Kempf
7,891,348 B2 * 2/2011 Colley ..... F41B 5/105 124/25
8,191,541 B2 * 6/2012 Shaffer ..... F41B 5/105 124/25
8,469,012 B2 * 6/2013 Bednar ..... F41B 5/105 124/25
8,479,719 B2 * 7/2013 Bednar ..... F41B 5/105 124/25
8,627,811 B1 1/2014 Darlington
8,651,095 B2 2/2014 Islas
8,763,595 B1 * 7/2014 Bednar ..... F41B 5/105 124/25
8,978,636 B2 3/2015 Bednar
8,991,375 B2 3/2015 McPherson
9,255,757 B2 2/2016 McPherson
2008/0135032 A1 6/2008 Islas
2011/0030666 A1 2/2011 Darlington
2012/0125302 A1 5/2012 Stanziale
(Continued)

*Primary Examiner* — John Ricci

(57) ABSTRACT

In at least one embodiment, a crossbow comprises a stock, a first limb, a first rotatable member, a second limb and a second rotatable member. A bowstring, a first power cable and a second power cable each extend between the first rotatable member and the second rotatable member. The first rotatable member and the second rotatable member are constructed and arranged to provide a left-off during draw of said bowstring in an amount of approximately 70%, 80%, 90% or 95% or more. The drawstring let-off reducing load on a latch assembly and/or a trigger assembly.

17 Claims, 14 Drawing Sheets

(56) References Cited

U.S. PATENT DOCUMENTS

| | | | | |
|---|---|---|---|---|
| 2013/0213373 | A1 | 8/2013 | Biafore, Jr. | |
| 2014/0261358 | A1 | 9/2014 | Pulkrabek et al. | |
| 2014/0283806 | A1* | 9/2014 | Bednar | F41B 5/105 124/25 |
| 2015/0285582 | A1 | 10/2015 | Chang | |
| 2015/0369556 | A1* | 12/2015 | Trpkovski | F41B 5/1426 124/25.6 |

* cited by examiner

HIGH LET-OFF CROSSBOW

CROSS-REFERENCE TO RELATED APPLICATIONS

This application claims the benefit of U.S. Provisional Patent Application No. 61/936,696, filed Feb. 6, 2014, entitled High Let-Off Crossbow, the entire disclosure of which is hereby incorporated herein by reference.

This application also claims the benefit of U.S. Provisional Patent Application No. 62/085,208, filed Nov. 26, 2014, entitled Compound Bow with Offset Synchronizer, the entire disclosure of which is hereby incorporated herein by reference.

BACKGROUND OF THE INVENTION

Crossbows typically include a bow assembly mounted on a stock portion, which includes a string latch and trigger assembly for holding and release of a drawn crossbow string. Crossbows may also include one or more cams and/or pulleys, and often multiple cables which can be held below the shooting axis by a portion of the stock.

Crossbows generally are configured in various sizes ranging from 31" to 42" in length and 20" to 30" in width. The length and width dimensions for a crossbow are important to archers. Crossbows having reduced dimensions are preferable, due to the ease of handling, cocking, and aiming, where a number of crossbows have a length of 34" long or less, and 20" wide.

Crossbows having a reduced overall length may have a limited power stroke. Maximizing crossbow power stroke and simultaneously reducing the overall length of the crossbow may be problematic. The power stroke of many crossbows may range from 9" to 20" and the industry average is 13.5". Every inch of power stroke enables an increase in the speed of the velocity of the projectile (about 25 fps/inch), and it is not uncommon for a crossbow to achieve 330 fps with about 150 lbs of maximum pull force on the crossbow string.

There are two well accepted methods for launching a bolt from a modern crossbow. One method employs a track type crossbow design. The other method employs a trackless design.

In the track type crossbow design, a bolt shaft rests in a track located in the stock of the crossbow in the full drawn cocked position. The bolt is launched from the crossbow by being pushed down the track with the bowstring and the bolt both maintaining intimate contact with the track until the bolt has cleared the crossbow. The bolts used in this type of crossbow are usually blunt at the rear end of the bolt. The bowstring that propels the bolt simply pushes against the blunt end to propel the bolt from the crossbow.

In the trackless type crossbow design, the bolt is supported on a rest towards the front of the bolt shaft and the rear of the bolt is supported by being nocked to the bowstring in the same manner as is used in conventional bows.

Some crossbows utilize one or more cams which have progressed from simple variable leveraging units consisting of circular shapes mounted eccentrically, to more complex shapes that are intended to create more energy storage for a given power stroke.

One consideration resulting from the use of cams on a crossbow is the risk of non-linear loading at the nock end of the projectile. The use of radically profiled cams may result in discrepancies in cam timing. A discrepancy in cam timing on a compound crossbow may cause the cam with the most mechanical advantage to pull the attached bowstring in the direction of the advantaged cam. The bowstring in turn, may impart a horizontal force to the end of the projectile shaft at an angle relative to the direction of the intended bolt travel.

The trackless crossbow design is more susceptible to the effects of the cams not being properly synchronized because the projectile is only supported at its front and is intimately attached to the bowstring at the rear or nock end of the bolt. In some cases, a bolt supported in this manner can become free of the front support prior to the rear end of the bolt clearing the bow during launch. Unfortunately, the rear end of the bolt is free to be acted upon by the external forces exerted by the bowstring as soon as it clears the trigger assembly. As a result, any cam synchronization problem that causes the bowstring to be pulled in one direction or the other during the launch of the bolt will have a tendency to displace the nock end of the bolt horizontally in the same direction. This results a corresponding degree of erratic projectile flight.

Given the adverse effects on projectile flight that can result from a lack of synchronization between twin cams on a crossbow, it would be desirable to have a crossbow that does not require synchronization and reacts in a consistent fashion during bolt launch without imparting unwanted forces to the rear end of the bolt.

It is desirable to provide a crossbow capable of increased mechanical efficiency and subsequent arrow launch speed while also being more pleasurable for an archer to use, requiring less maintenance, having a shorter width between the limbs as measured axle-to-axle between cams or rotation members.

In the past archers have used handheld compound bows incorporating one or more complex shaped cams to simultaneously increase arrow speed, and to provide a desired let-off, to assist an archer in the holding or retention of a bowstring in a drawn position during aiming and prior to the release of a bowstring to shoot an arrow. In the past experimentation has occurred concerning the optimal amount of let-off for a handheld compound bow at draw. The results of the experimentation has identified that a direct relationship exists between the amount of let-off for a handheld compound bow and the amount of torque which occurs on a bow as let-off is increased. In this instance, the torque at issue refers to non-linear forces applied to the bow by the archers hand as it pushes against the riser, which results in a twisting force inadvertently being applied to the bow. In a high let-off compound bow design, torque is increased. In a high let-off compound bow design an archer will frequently grasp a handle exerting an unequal or lateral pressure on the handle creating torque, which is out of alignment relative to the shooting plane for the bow. As the let-off for the handheld compound bow increases, the torque and misalignment of the bow relative to the shooting plane increases, resulting in an inaccurate arrow flight. A balance has been made between torque for a handheld compound bow, the desired shooting accuracy, as well as the let-off of the bow at draw.

As a result of the inaccuracies resulting from increased let-off and increased torque, bow manufactures have purposely limited the amount of let-off for a handheld compound bow. Typically, commercial handheld compound bows have a let-off in the range of 60% to 80%. Handheld compound bow manufacturers have known that the provision of a let-off in excess of 80%, and the associated torque and inaccuracy of an arrow flight is undesirable, which reduce the performance of the handheld compound bow to an acceptable level. Bow manufacturers have therefore determined that increasing the let-off for a handheld compound bow above 80% is undesirable, and creates an excessive and unacceptable level of torque, degrading the shooting accuracy and performance for the compound bow.

Therefore, in the past, it has been known that in compound bows, it is highly desirable, if not imperative, to restrict the level of let-off for a compound bow to regulate the undesirable effects of torque on shooting accuracy.

To the extent that a compound crossbow exhibits let-off, the amount of let-off is typically less than the let-off found in handheld bows. In a handheld bow, a higher amount of let-off will reduce the pull force required to maintain the bow at full draw—thus, a high let-off handheld bow can be easier to hold and shoot. In crossbows, the archer does not provide the force to maintain the crossbow string at full draw, so shooter fatigue does not encourage higher amounts of let-off.

All US patents and applications and all other published documents mentioned anywhere in this application are incorporated herein by reference in their entirety. Without limiting the scope of the invention a brief summary of some of the claimed embodiments of the invention is set forth below. Additional details of the summarized embodiments of the invention and/or additional embodiments of the invention may be found in the Detailed Description of the Invention below. A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In at least one embodiment, the invention relates to crossbows having bow limbs each comprising a cam; a cam and a rotatable member; or a rotatable member.

In at least one embodiment of the inventive crossbow each cam and/or rotatable member has an axle which enables the cam or rotatable member to rotate relative to a bow limb during draw and release of a crossbow bowstring.

In at least one embodiment, the axle-to-axle length dimension between the cams, cam and rotatable member, or the rotatable members is shortened/reduced.

In some embodiments of the invention, the configuration of the cams, cam and rotatable member, or rotatable members, in association with the shortened axle-to-axle length dimension, reduces the stress and/or string tension on the crossbow trigger assembly/mechanism during draw and hold of the crossbow string as placed into a fully drawn position.

In at least one embodiment of the invention, the configuration of the cams, cam and rotatable member, rotatable members, and reduced axle-to-axle length dimension between the limbs, results in a significant let-off of the crossbow string during draw, in an amount equal to or exceeding 80%, 90%, and in some embodiments equal to or exceeding 95%.

In some embodiments, the crossbow is formed of lighter weight yet sufficiently sturdy plastic or composite materials.

In some embodiments of the invention, the configuration of the limbs, cables, or cams/rotatable members decreases the overall length of the crossbow, and increases the draw length and power stroke for the crossbow, while simultaneously providing a high level of let-off for the crossbow string during draw of approximating 80%, 90%, and/or 95% or greater.

In at least one embodiment, a crossbow comprises a stock, a first limb, a first rotatable member, a second limb and a second rotatable member. A bowstring and a first power cable each extend between the first rotatable member and the second rotatable member. The crossbow defines a shooting axis, and the stock extends below the shooting axis. In some embodiments, the first power cable is positioned below the shooting axis. In some embodiments, a crossbow comprises a cable positioner arranged to position the first power cable below the stock. In some embodiments, both a first power cable and a second power cable are positioned below the shooting axis.

In at least one embodiment, one aspect is to have a crossbow having a reduced overall length dimension, and a shorter overall width dimension for the limbs measured axle-to-axle. Another aspect of one embodiment is to provide a crossbow having a reduced length dimension where the limbs are oriented in a traditional direction, or in a reversed direction. A further aspect is a crossbow having a relatively high left-off from draw of 80%, 90%, or 95% or more. Another aspect is a crossbow being formed of lighter weight materials to reduce the overall weight of the crossbow.

Yet another aspect is a crossbow being formed of plastic or composite materials to reduce weight for the crossbow which maintains performance and durability objectives. A further aspect is to provide a crossbow having reduced stress forces exposed to the latch and the trigger assemblies for the crossbow during use.

In one embodiment, the invention is directed to a crossbow comprising a limb mounting portion, a first limb supported by the limb mounting portion and a second limb supported by the limb mounting portion. A rotatable member is pivotally mounted upon the first limb for rotation about a first axle. The rotatable member may include at least one track. A second rotatable member is pivotally mounted upon the second limb for rotation about a second axle. The second rotatable member may have a primary string payout track along its periphery to accommodate a cable therein, a secondary string payout track to accommodate a cable therein and a take-up track to accommodate a cable therein.

In at least one embodiment the crossbow will further comprise a first power cable and a second power cable. The first power cable may have a first end portion which may engage a cam assembly and a second end portion may engage a cam assembly. The first end portion may be received in the primary string payout track and the second end portion may be received in the secondary string payout track.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
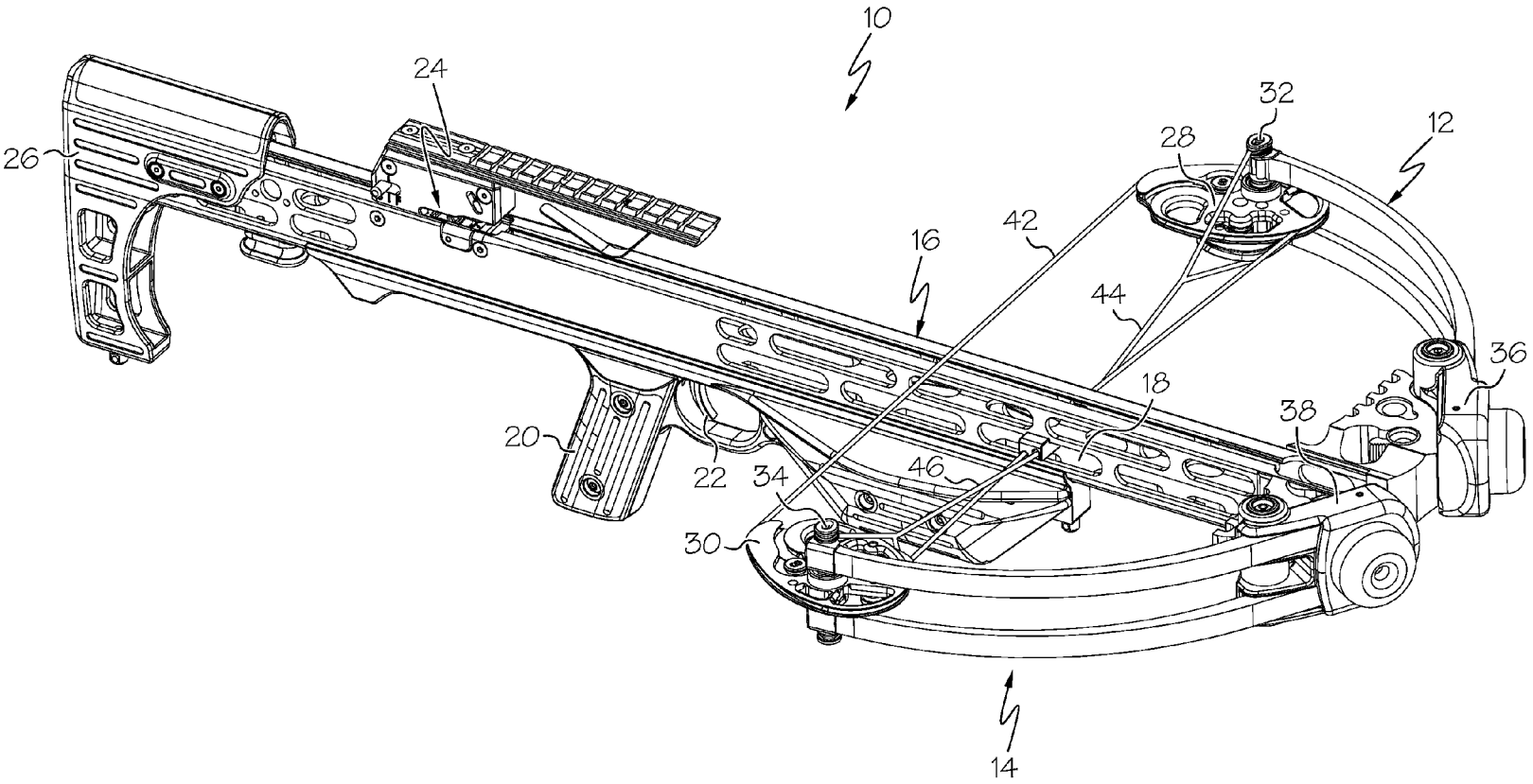
FIG. 1 shows an alternative isometric environmental view of one embodiment of a crossbow without the bowstring or cables.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

In at least one embodiment as depicted in FIG. 1 a crossbow is generally designated by reference numeral 10. "Crossbow" as used herein is intended to encompass any suitable type of compound crossbow, including single cam crossbows, CPS crossbows and/or cam-and-a-half crossbows, dual cam 1.5/hybrid/ICPS cam, binary cam and/or twin cam crossbows. The crossbow 10 includes limbs 12 and 14. Limbs 12 and 14 are mounted to a stock 16 which may include channel openings 18. A grip 20 is also mounted to the stock 16, and a trigger assembly 22 is positioned proximate to the grip 20 and is operatively connected to a latch assembly 24. A butt end 26 is engaged to the stock 16 opposite to the limbs 12, 14.

In at least one embodiment a first cam or rotatable member 28 is rotatably mounted to limb 12 by a first axle 32 and a second cam or rotatable member 30 is rotatably mounted to limb 14 by a second axle 34.

In at least one embodiment, limbs 12 and 14 are engaged to the stock 16 through the use of first and second limb cups 36 and 38 respectively. In other embodiments, the limbs 12 and 14 may be engaged to the stock 16 through either a permanent, releasable, adjustable or variable affixation mechanism in substitution for the limb cups 36 and 38.

At least one embodiment, limbs 12 and 14 have a length dimension from an end as inserted into a respective limb cups 36, 38 to the tip proximate to either the first axle 32 or the second axle 34, of approximately 12 inches. In some embodiments the limbs 12 and 14 may have a length dimension which is larger or smaller than 12 inches. In some embodiments, the length dimension for the limbs 12 and 14 is less than the length dimension utilized with known crossbows.

In some embodiments, in order to increase the power stroke for the crossbow 10, the stiffness of the limbs 12 and 14 are increased to provide a larger load on the bowstring 42.

Figure 2:
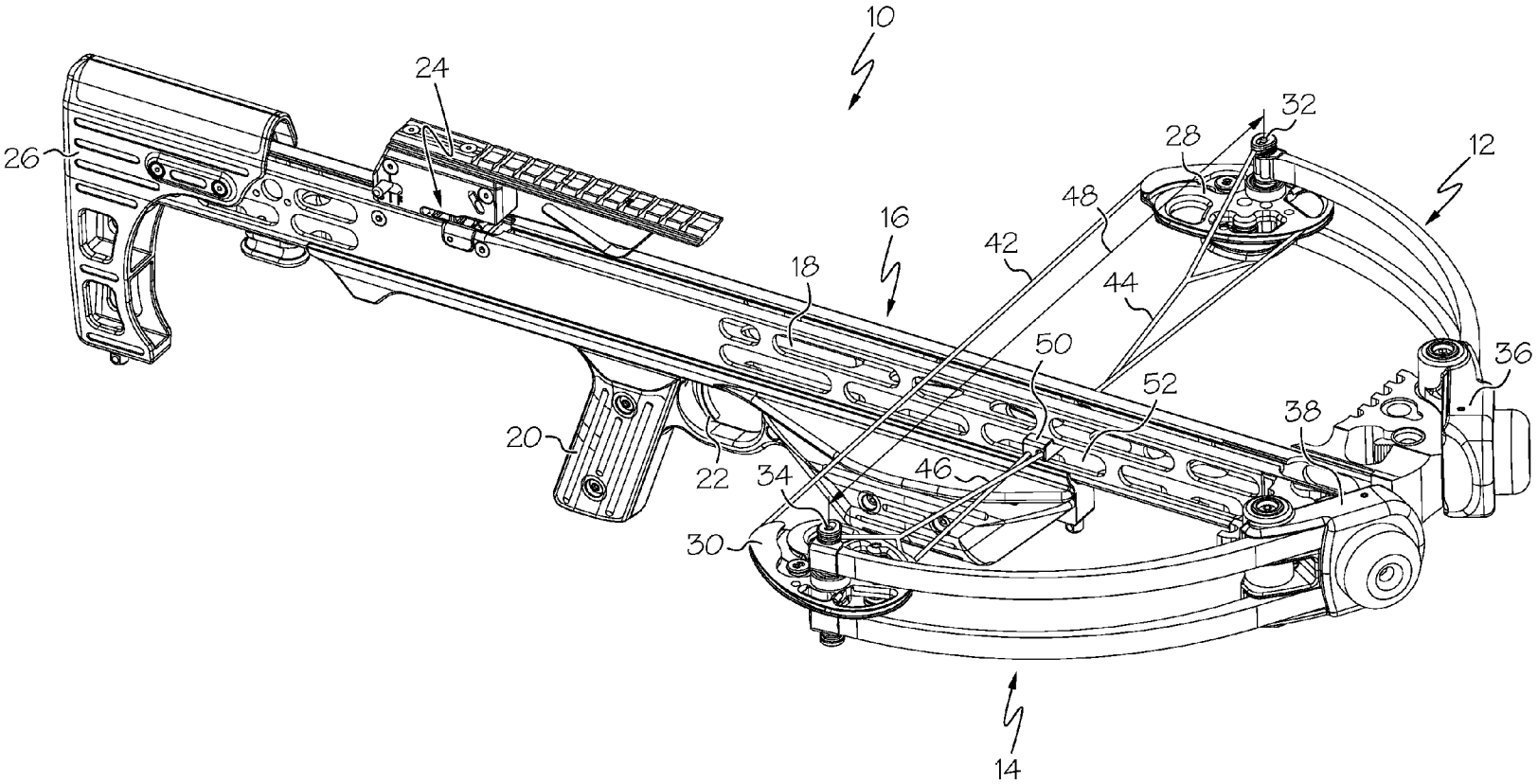
FIG. 2 shows an alternative isometric environmental view of one embodiment of a crossbow having a bowstring and cables in a brace position.

In at least one embodiment as shown in FIG. 2 the crossbow 10 includes a bowstring 42, a first power cable 44, and a second power cable 46. The crossbow 10 depicted in FIG. 2 is shown at a brace condition. In the brace condition, crossbow 10 includes a first axle 32 and second axle 34 having an axle-to-axle width dimension of approximately 17¾ to 18 inches. In other embodiments the first axle 32 to the second axle 34 width dimension of 17¾ to 18 inches may be increased or decreased to provide a desired level of performance for the crossbow 10.

In some embodiments, the shape and features of the first cam 28, second cam 30, bowstring 42, first power cable 44, and second power cable 46 may include elements such as force vectoring anchors, sheaves, bowstring tracks, cable tracks, axis of rotation and other elements as described in U.S. Pat. No. 8,020,554 which are Incorporated by reference herein in their entireties. In some embodiments the first cam 28, second cam 30, bowstring 42, first power cable 44 and second power cable 46 operate and interrelate with respect to each other as described in U.S. Pat. No. 8,020,554 which is incorporated herein by reference in its entirety.

Generally, when a crossbow 10 is drawn, a drawing force is applied to a portion of the bowstring 42 in the rear direction toward a latch assembly 24. As the bowstring 42 moves rearward, the limbs 12, 14 flex and store energy. The bowstring 42 may be retained in a cocked or drawn position by the latch assembly 24. A trigger assembly (e.g., including a trigger) 22 may selectively release the bowstring 42 from the latch assembly 24, which will allow the crossbow 10 to fire an arrow or bolt (not shown).

In at least one embodiment, the selected shape and features for the first cam 30, second cam 32, bowstring 42, first power cable 44, and second power cable 46 in operation provide a left-off during draw of the bowstring 42 equal to approximately 70%, 80%, 90% or 95% or more. The application of force to the rotatable members 28, 30 and the structure resulting in appropriate let-off is described below in detail, for example with respect to FIGS. 7-10.

In some embodiments the provision of a let-off of approximately 70%, 80%, 90% or 95% or more during draw of the bowstring 42, reduces the load or string tension at full draw on the bowstring 42, bowstring latch assembly 24, and/or trigger 22, which in turn will increase the useful life of the bowstring 42, bowstring latch assembly 24, and/or trigger assembly 22, reducing the frequency of required repairs or replacement.

In some embodiments, the provision of a left-off of approximately 70%, 80%, 90% or 95% or more during draw of the bowstring 42 enables the components of the crossbow 10 to be formed of alternative or lighter weight materials, such as plastic or composite materials, low friction materials, such as ceramic materials or thermoplastic materials such as nylon, high-density polyethylene, or polytetrafluoroethylene, polymer thermoplastic or thermoset polymers, a lubricious polymer, a low friction material such as polyoxymethylene (POM) and/or polytetrafluoroethylene (PTFE), Delrin® acetal resin or Delrin® AF acetal resin available from E. I. du Pont de Nemours and Company, carbon materials, or may be formed of composite materials formed of one or more combinations of any of the materials identified herein, or in combination with other materials not identified herein which provide the functions and features as described without adversely affecting the durability and/or performance of the crossbow 10. Crossbows 10 having improved performance and durability and which are being formed of materials which are lighter in weight, are preferable to an archer.

In at least one embodiment, a cable positioner 50 is disposed in a slide channel 52. In some embodiments the cable positioner 50 includes a first groove 54 and a second groove 56 which established channels or troughs which traverse the entire width of the cable positioner 50. In at least one embodiment, the cable positioner 50 includes opposite tabs 58 which extend upwardly from a substantially flat contact surface 60. In some embodiments the contact surface 60 slidably engage the flat upper surface of the slide channel 52. The first power cable 44 and the second power cable 46 are positioned within a first groove 54 and a second groove 56 respectively within the cable positioner 50. In some embodiments, the first groove 54 and the second groove 56 are not equal in depth relative to each other. In at least one embodiment, the first groove 54 and the second groove 56 within the cable positioner 50 cross, enabling the first power cable 44 and the second power cable 46 to cross each other below the projectile channel for the crossbow 10. In one embodiment as depicted in FIG. 6 one side of the second groove 56 is positioned forwardly toward the shooting end of the crossbow 10 which has a greater depth as compared to the first groove 54 which is positioned rearwardly toward the butt end 26.

Figure 6:
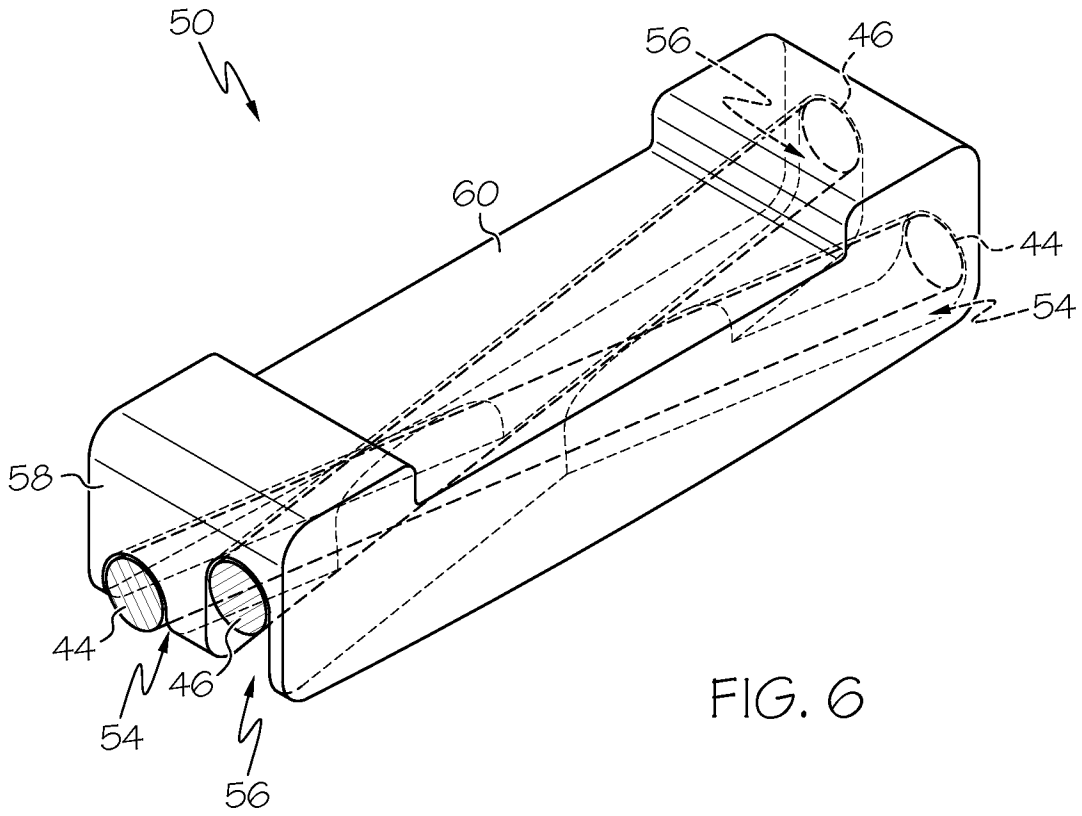
FIG. 6 is a detail isometric view of one embodiment of a cable positioner.

In at least one embodiment, the crossing of the first power cable 44 and the second power cable 46 positions the second power cable 46 rearwardly toward the butt end 26 on the opposite side of the cable positioner 50, as seen in phantom line in FIG. 6. In at least one embodiment, the crossing of the first power cable 44 and the second power cable 46 positions the first power cable 44 forwardly toward the shooting end, on the opposite side of the cable positioner 50 as seen in phantom line in FIG. 6.

In at least one embodiment as depicted in FIG. 2, the cable positioner 50 is positioned forwardly within the slide channel 52 toward the shooting end when the crossbow 10 is in the brace condition.

In at least one embodiment, the tabs 58 are positioned exterior and above the slide channel 52, and are disposed on opposite sides of the stock 16. Tabs 58 in at least one embodiment are used to prevent lateral migration of the cable positioner 50 relative to the slide channel 52 and stock 16 during draw and release of a bowstring 42.

In some embodiments, the cable positioner 50 is formed of plastic. In other embodiments, the cable positioner 50 may be formed of composite materials, low friction materials, such as ceramic materials or thermoplastic materials such as nylon, high-density polyethylene, or polytetrafluoroethylene, metal, polymer thermoplastics or thermoset polymers, lubricious polymers, low friction materials such as polyoxymethylene (POM) and/or polytetrafluoroethylene (PTFE), Delrin® acetal resin or Delrin® AF acetal resin available from E. I. du Pont de Nemours and Company. In other embodiments, the cable positioner 50 may be formed of a composite material formed of one or more combinations of any of the materials identified herein, or in combination with other materials not identified herein which provide the functions and features as described.

Figure 3:
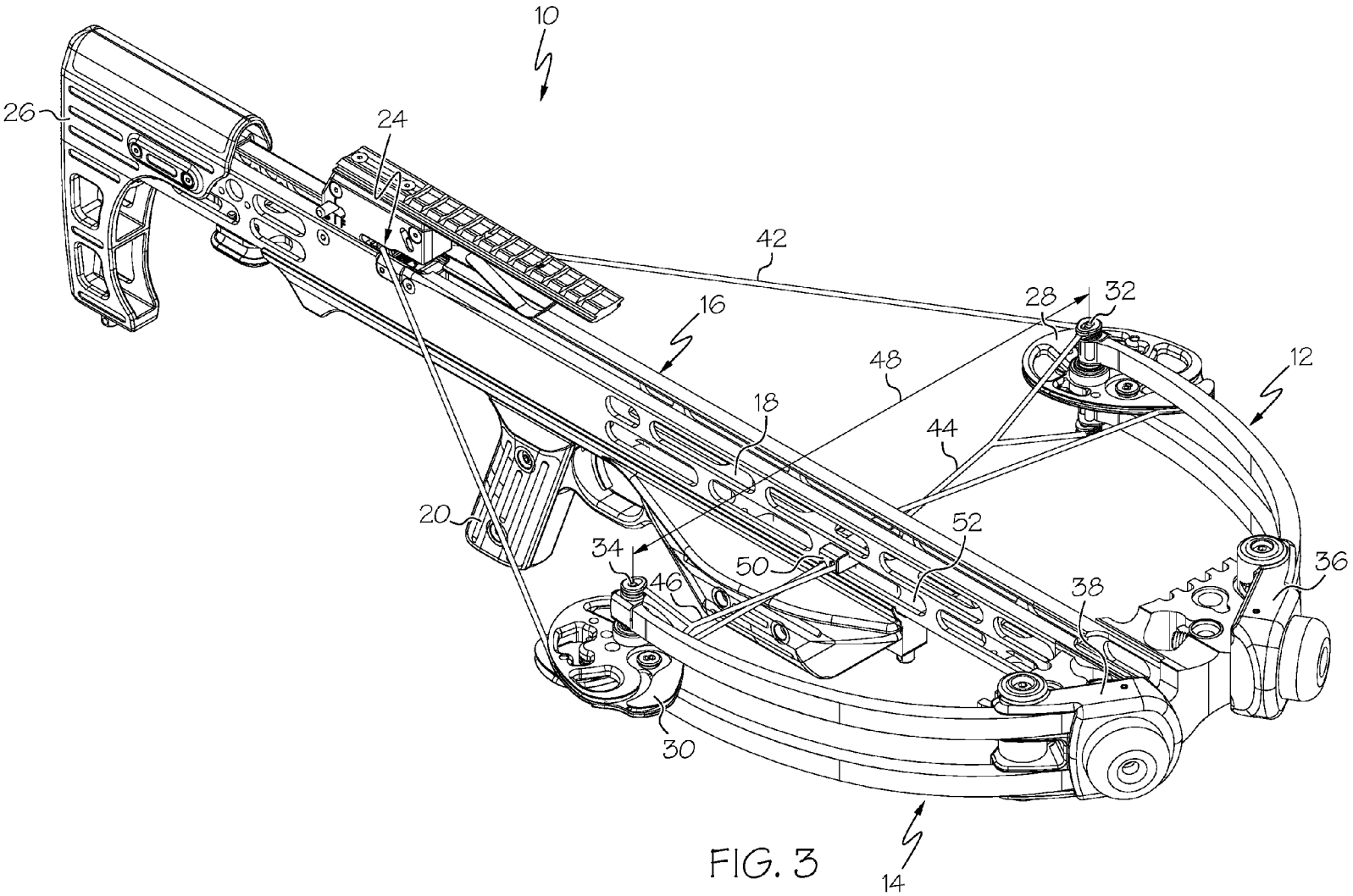
FIG. 3 shows an alternative isometric environmental view of one embodiment of a crossbow having a bowstring and cables in a drawn position.

In at least one alternative embodiment as depicted in FIG. 3 the bowstring 42 has been retracted into the drawn position and engaged to the latch assembly 24. In this alternative embodiment, the cable positioner 50 has moved rearwardly within the slide channel 52 towards the butt end 26. The first power cable 44 and the second power cable 46 along with the bowstring 42 during draw have caused the first cam 28 and the second cam 32 to rotate, and the first limb 12 and second limb 14 to flex inwardly to load the bowstring 42 to propel a projectile. The shape and features of the first cam 28 and second cam 30 in conjunction with the bowstring 42, first power cable 44 and second power cable 46 have been configured to provide a left-off during draw of the bowstring 42 in an amount of approximately 70%, 80%, 90%, and in some embodiments in an in an amount equal to or greater than 95%.

In some embodiments, drawing the bowstring 42 causes the rotatable members 28, 30 to rotate, wherein at least one of the first or second cable 44, 46 will be taken up on a cam track. The cable 44, 46 take-up causes the limbs 12, 14 to flex, storing energy.

In some embodiments, the first power cable 44 will extend to an opposite rotatable member. For example, a first power cable 44 can be anchored at a first cam 28 associated with a first limb 12, and can extend to the second cam 30. The first power cable 44 can be anchored to the second cam 30. At least a portion of the first power cable 44 can be oriented in a power cable take-up track associated with the second cam 30. As the bowstring 42 is drawn, first power cable 44 can be taken up by the power cable take-up track. The specific shape of the power cable take-up track impacts the compounding action of the crossbow 10.

In some embodiments, the crossbow 10 can comprise a second power cable 46. The second power cable 46 can be anchored at one end to a second cam 30 associated with the second limb 14, and extend to the first cam 28. The second power cable 46 can be anchored to the first cam 28, and at least a portion of the second power cable 46 can be oriented in a second power cable take-up track associated with the first cam 28. In some embodiments, the first power cable take-up track and the second power cable take-up track can comprise mirror images of one another, for example taken across a mirroring axis. Similarly, the first power cable 44 and second power cable 46 can comprise mirror images of one another, for example taken across a mirroring axis.

The power cable take-up tracks are shaped to allow "let-off" or a reduction in the force that must be applied to the bowstring 42 to maintain the crossbow 10 in the fully drawn orientation. In some embodiments of the crossbow 10, the let-off may exceed 70%, 80%, 90% and in addition, may further exceed 95% for a high let-off crossbow.

In at least one embodiment the cams 28, 30 when at a full draw have facilitated a power cable force vector F.sub.p as shown and described in U.S. Pat. No. 8,020,554, to move to the bowstring 42 side of the rotatable member axis. Thus, the bowstring 42 and first power cable 44 apply moments to the first cam 28, and second cam 30 in a common direction, for example counterclockwise which exceed the moment applied by the second power cable 46, to establish in at least one embodiment, a left-off which may equal or exceed 70% and in other embodiments which may result in a let-off for a crossbow draw equal to or exceeding 80%, 90%, or 95%. The moments from the bowstring 42 and first power cable 44 act against a moment applied by the second power cable 46 in the opposite direction, for example clockwise. The let-off of the crossbow bowstring 42 resulting from the translocation of the power cable force vector F.sub.p to the bowstring 42 side of the rotatable member axis may be applied to any embodiments for any shape of cam for use with a single or dual cam or other crossbow as identified herein.

In at least one embodiment the take-up track for the first cam 28 and the second cam 30 are substantially elliptical in shape.

In some embodiments, the inward flexion of the first limb 12 and the second limb 14 following draw of the bowstring 42 causes a reduction in the axle-to-axle width dimension 48 between the first axle 32 and the second axle 34, as compared to the axle-to-axle width dimension 48 of the bowstring 42 in the brace condition.

Figure 4:
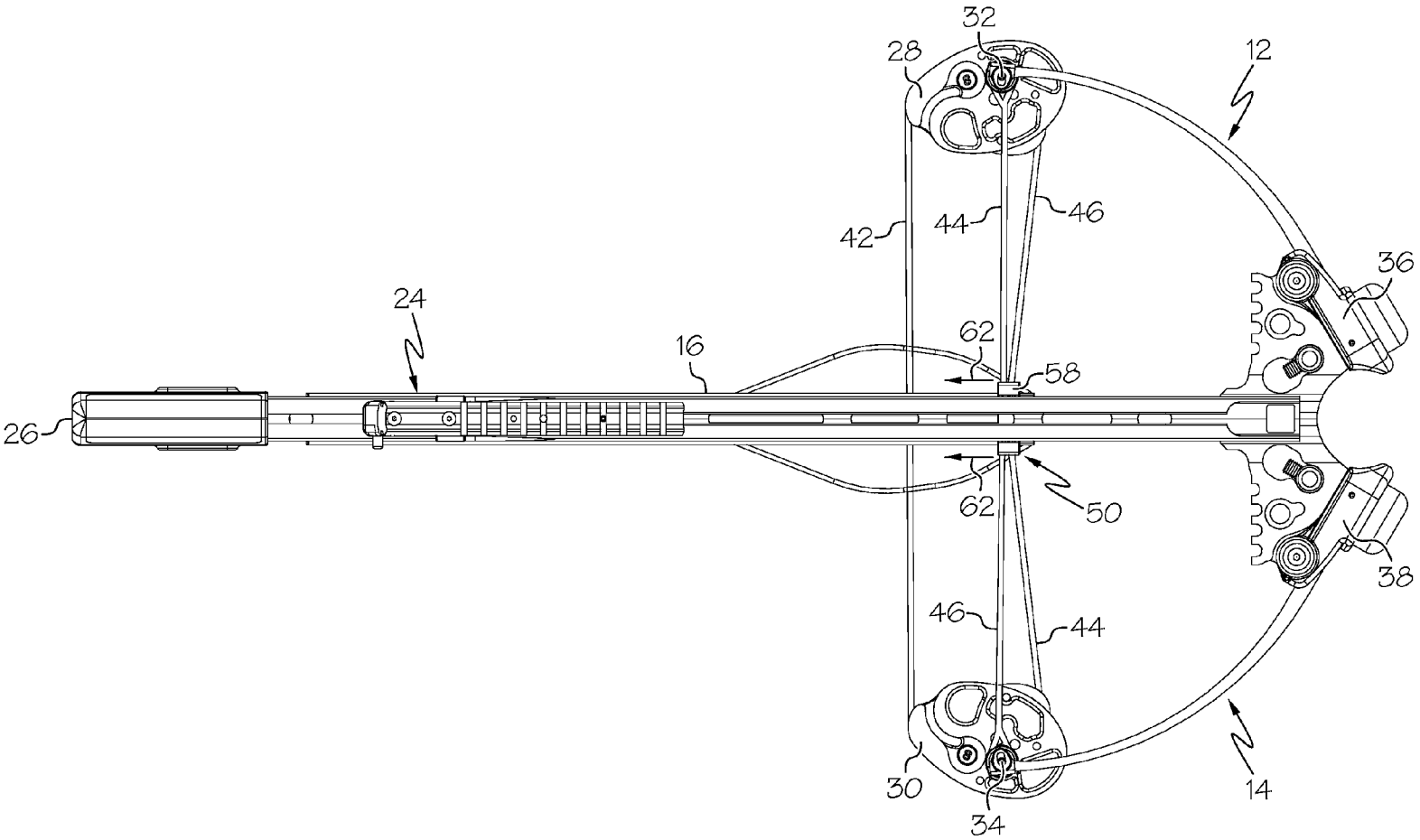
FIG. 4 shows an alternative top view of one embodiment of a crossbow having bowstring and cables in a brace position.

In at least one embodiment as depicted in FIG. 4 a top view of the crossbow 10 is shown. The cable positioner 50 is shown in the forward position towards the shooting end in the brace condition. During the draw of the bowstring 40, the cable positioner 50 will slide in the direction of arrow 62 rearwardly within the slide channel 52 towards the butt end 26.

Figure 5:
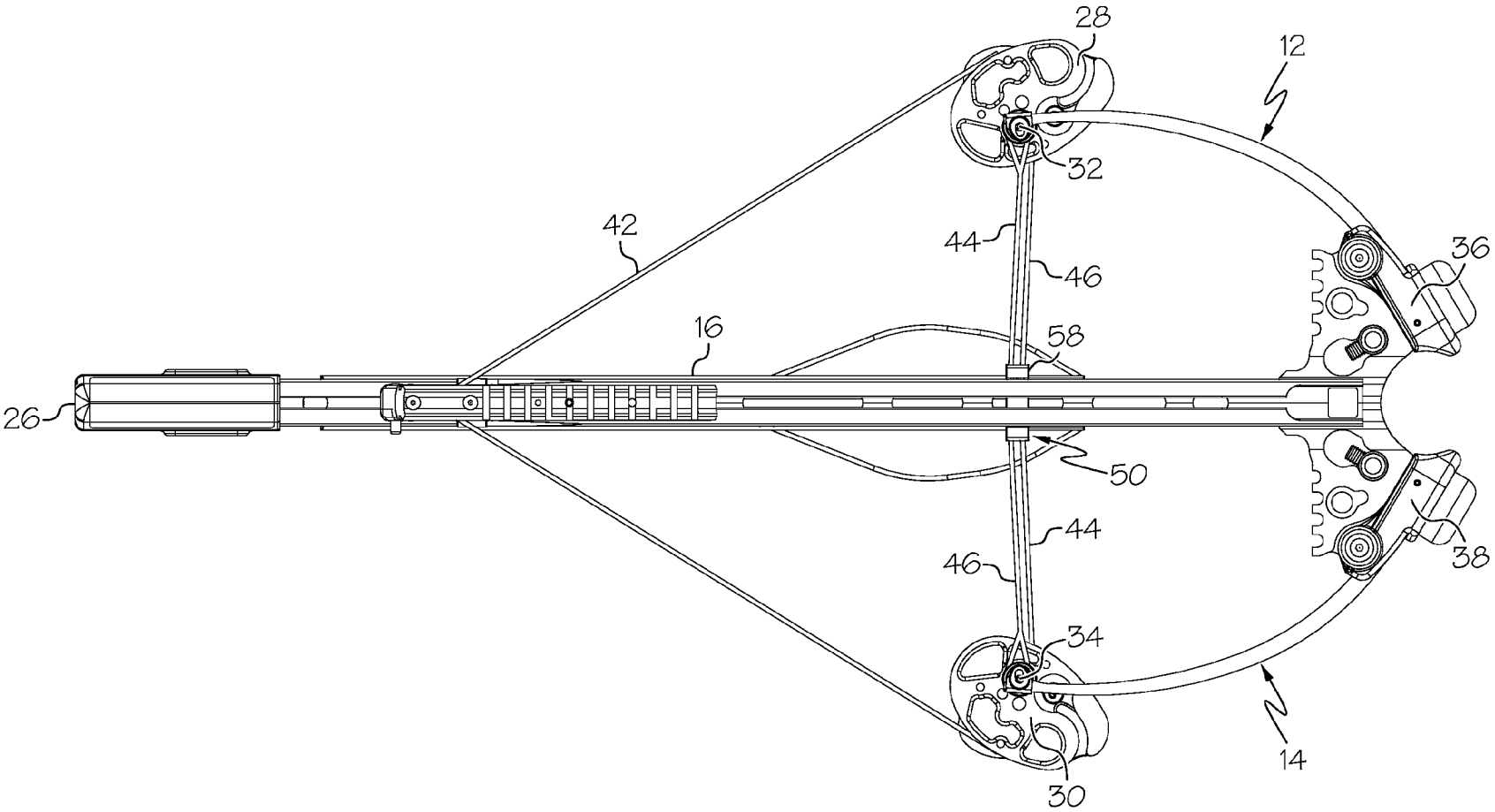
FIG. 5 shows an alternative top view of one embodiment of a crossbow having bowstring and cables in a drawn position.

FIG. 5 shows one embodiment of the crossbow 10 having the bowstring 42 in the drawn position engaged to the latch assembly 24. In this embodiment, the cable positioner 50 has been drawn rearwardly within slide channel 52 towards the butt end 26.

In some embodiments, the overall length dimension for the crossbow 10 between the butt end 26, and the shooting end is shortened or reduced in dimension. In certain embodiments, the latch assembly 24 has been positioned rearwardly toward the butt end 26 to provide the crossbow 10 with a power stroke of sufficient or increased length for ejection of a projectile.

In other embodiments, alternatively or simultaneously, the first limb 12 and the second limb 14 have been reduced or shortened in dimension. The shortening of the length dimension of the first limb 12 and the second limb 14 may result in a reduction in the axle-to-axle width dimension 48 between the first axle 32 and the second axle 30. In this embodiment, to provide a sufficient projectile speed on discharge, the stiffness of the first limb 12 and the second limb 14 may be increased to enhance the velocity of a released projectile.

In some embodiments, the provision of an enhanced let-off for the bowstring 42 during draw from a brace position enables the stock 16, but end 26, and other elements of the crossbow 10 to be formed of lighter weight materials such as plastic and composite material, as identified herein, thereby reducing the overall weight of the crossbow 10.

The shortening/reduction in the length dimension of the crossbow 10, as well as the length dimension for the first limb 12 and second limb 14 reduces the overall width dimension of the crossbow 10, improving the ease of handling and use of the crossbow 10 by an archer.

In some embodiments a crossbow 10 may include an enlarged latch assembly 24 having multiple draw positions. In this embodiment, the trigger assembly 22 may actuate multiple catch positions of the latch assembly 24 to simultaneously release a drawn bowstring 42 from any one of the multiple different draw positions.

In some embodiments, the first limb 12 and the second limb 14, in conjunction with the first limb cup 36 and the second limb cup 38 may provide adjustable or variable flexion for the first limb 12 and second limb 14 to provide a variable power stroke for the crossbow 10.

In some embodiments, the reduction of the length of the crossbow 10, the axle-to-axle width dimension for the crossbow 10, and the weight of the crossbow 10 due to the use of plastic or composite materials, results in the lowering of the holding weight of the crossbow 10 which in turn reduces the load and stress on the latch assembly 24 and/or trigger assembly 22, increasing the useful life of the bowstring 42, latch assembly 24, and/or trigger assembly 22.

In some embodiments, the reduction of the length of the crossbow 10, the axle-to-axle width dimension for the crossbow 10, the weight of the crossbow 10 due to the use of plastic or composite materials lowers the holding weight of the crossbow 10 at draw, reducing load and/or stress on the latch assembly 24 and/or trigger assembly 22, permitting alternative lighter weight materials to be utilized in the fabrication of the latch assembly 24 and/or trigger assembly 22 while maintaining performance and durability objectives.

Figure 7:
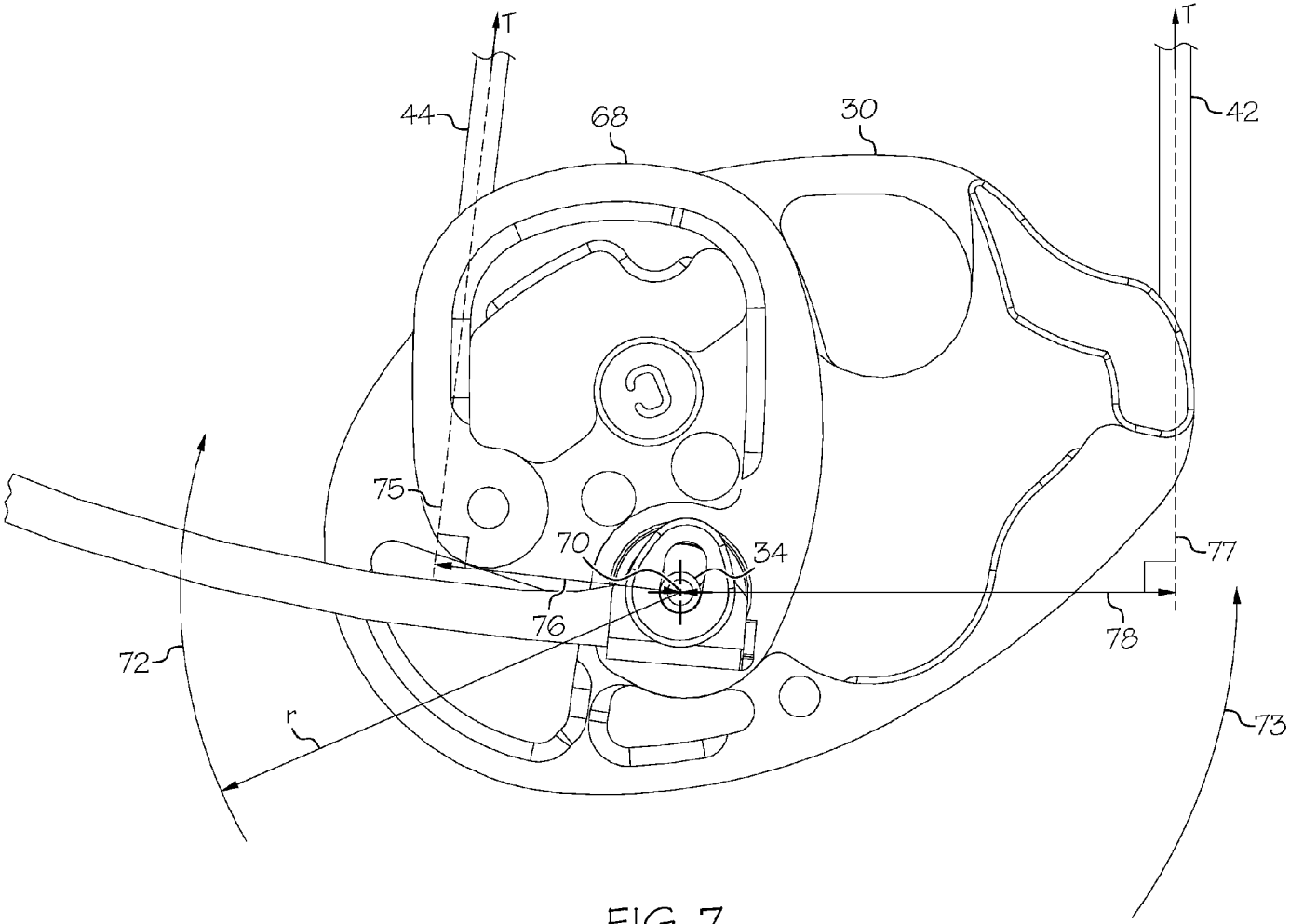
FIG. 7 shows a detail of a rotatable member.

FIG. 7 shows a detail of an embodiment of a rotatable member 30 when the crossbow is in a brace condition, for the purpose of illustrating the rotating forces that are applied to the rotatable member 30 by the bowstring 42 and power cable 44. FIG. 7 shows a view of an underside of the rotatable member 30 and the power cable take-up track 68 is visible.

Tension T in the power cable 44 applies a rotational force in a first rotational direction 72 (e.g. clockwise) about the center of rotation 70 of the rotatable member 30. The specific rotational moment applied by the power cable 44 can be calculated using the magnitude of the tension T multiplied by the power cable moment arm 76. The power cable force vector 75 can be extended as necessary, and the power cable moment arm 76 is oriented orthogonal to the power cable force vector 75. The power cable moment arm 76 extends to the center of rotation 70.

Tension T in the bowstring 42 applies a rotational force in a second rotational direction 73 (e.g. counter-clockwise) about the center of rotation 70 of the rotatable member 30. The specific rotational moment applied by the bowstring 42 can be calculated using the magnitude of the tension T multiplied by the bowstring moment arm 78. The bowstring force vector 77 can be extended as necessary, and the bowstring moment arm 78 is oriented orthogonal to the bowstring force vector 77. The bowstring moment arm 78 extends to the center of rotation 70.

When the crossbow is drawn, an archer pulls the bowstring 42 backwards. When the rotational force 73 applied by the bowstring 42 overpowers the rotational force 72 applied by the power cable 44, the rotatable member 30 will rotate.

In some embodiments, a crossbow 10 has a first orientation, for example in a brace condition.

Figure 8:
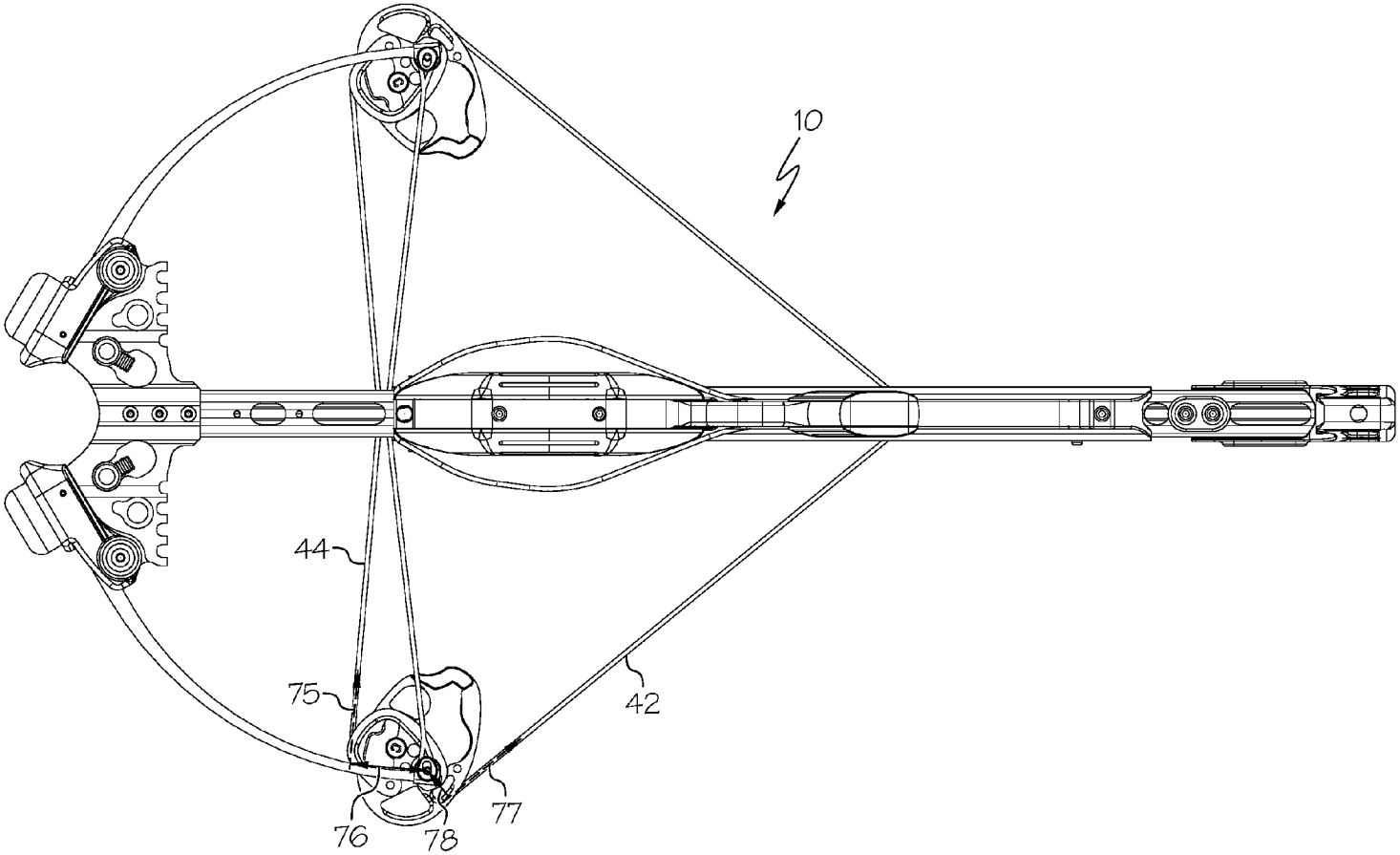
FIG. 8 shows an embodiment of a crossbow in a partially drawn condition.

FIG. 8 shows a crossbow 10 partially drawn, wherein the rotatable member 30 has begun to rotate. As the rotatable member rotates 30, the directions of the power cable force vector 75 and bowstring force vector 77 can change. Also, the power cable moment arm 76 and the bowstring moment arm 78 will change.

During this portion of draw, the length of the bowstring moment arm 78 is less than the length of the power cable moment arm 76.

Figure 9:
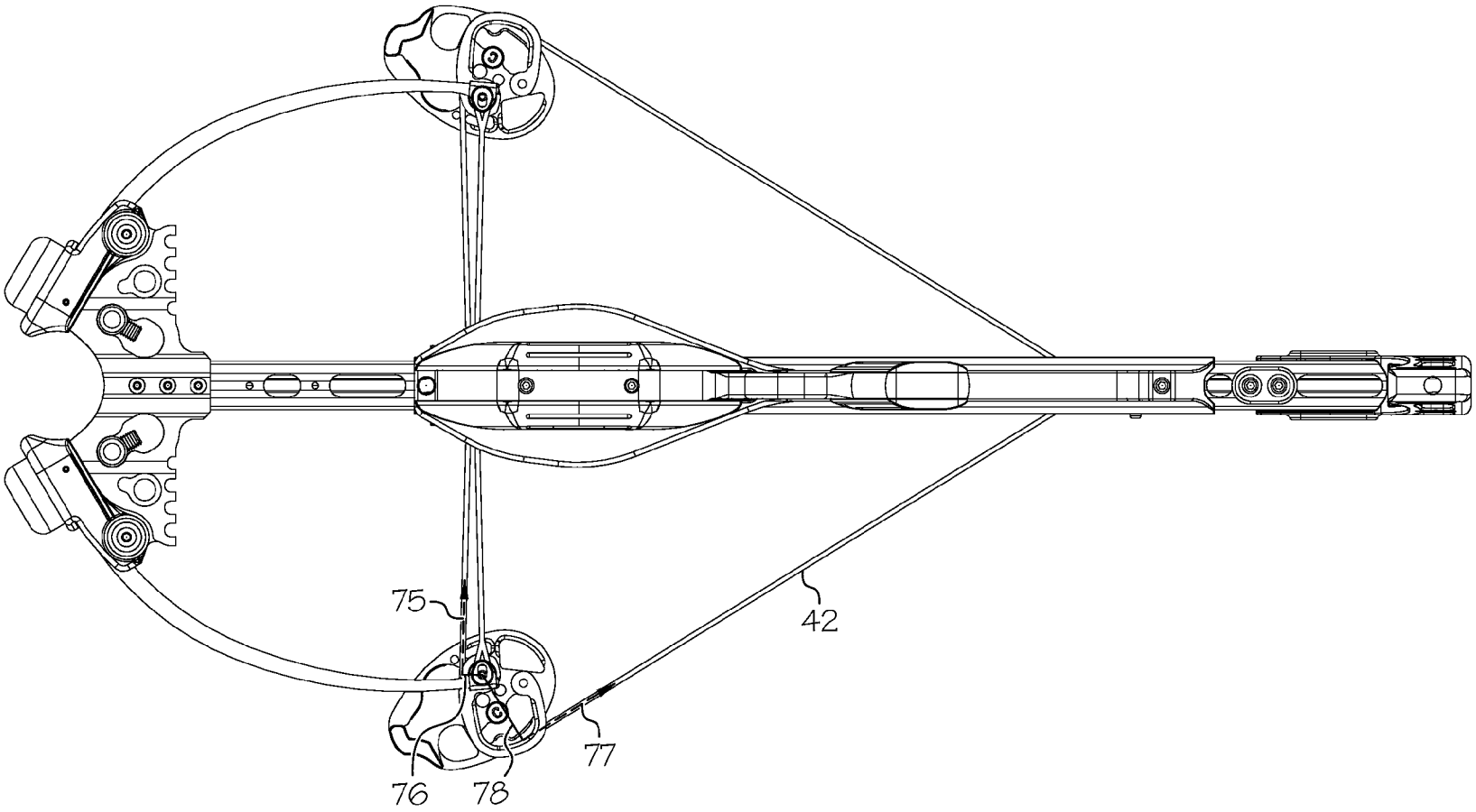
FIG. 9 shows an embodiment of a crossbow in a fully drawn condition.

FIG. 9 shows the crossbow 10 fully drawn. Desirably, the length of the bowstring moment arm 78 is greater than the length of the power cable moment arm 76.

During the draw cycle, the bowstring moment arm 78 and the power cable moment arm 76 change in length. Desirably, the bowstring moment arm 78 reaches a minimum value at some point of the draw cycle. For example, FIG. 8 shows the bowstring moment arm 78 at close to its minimum value.

In some embodiments, the crossbow 10 comprises a second orientation, wherein the crossbow 10 is partially drawn. In the second orientation, the bowstring moment arm 78 has a minimum value. In some embodiments, as the crossbow 10 transitions from the first orientation to the second orientation, the bowstring moment arm 78 reduces in value. In some embodiments, as the crossbow 10 transitions from the first orientation to the second orientation, the power cable moment arm 76 increases in value.

Desirably, the power cable moment arm 76 reaches a maximum value at some point of the draw cycle. In some embodiments, the power cable moment arm 76 reaches maximum value simultaneously with the bowstring moment arm 78 reaching its minimum value. In some embodiments, the power cable moment arm 76 has a maximum value in the crossbow's second orientation. In some other embodiments, the crossbow 10 has a third orientation, wherein the draw length of the third orientation is greater than the draw length of the second orientation, and the power cable moment arm 76 has a maximum value in the crossbow's third orientation.

As the draw cycle continues, the power cable moment arm 76 is desirably reduced in length and the bowstring moment arm 78 is desirably increased in length.

In some embodiments, the crossbow 10 has a fourth orientation, wherein the crossbow 10 is fully drawn. Desirably, the bowstring 42 is engaged by a latch 24 (see FIG. 1) when the crossbow 10 is fully drawn. Desirably, the bowstring moment arm 78 will reach its maximum value and the power cable moment arm 76 will reach its minimum value in the fourth orientation.

The combination of a minimum power cable moment arm 76 and a maximum bowstring moment arm 78 at full draw results in a maximum force let-off in the bowstring 42 at full draw.

Figure 10:
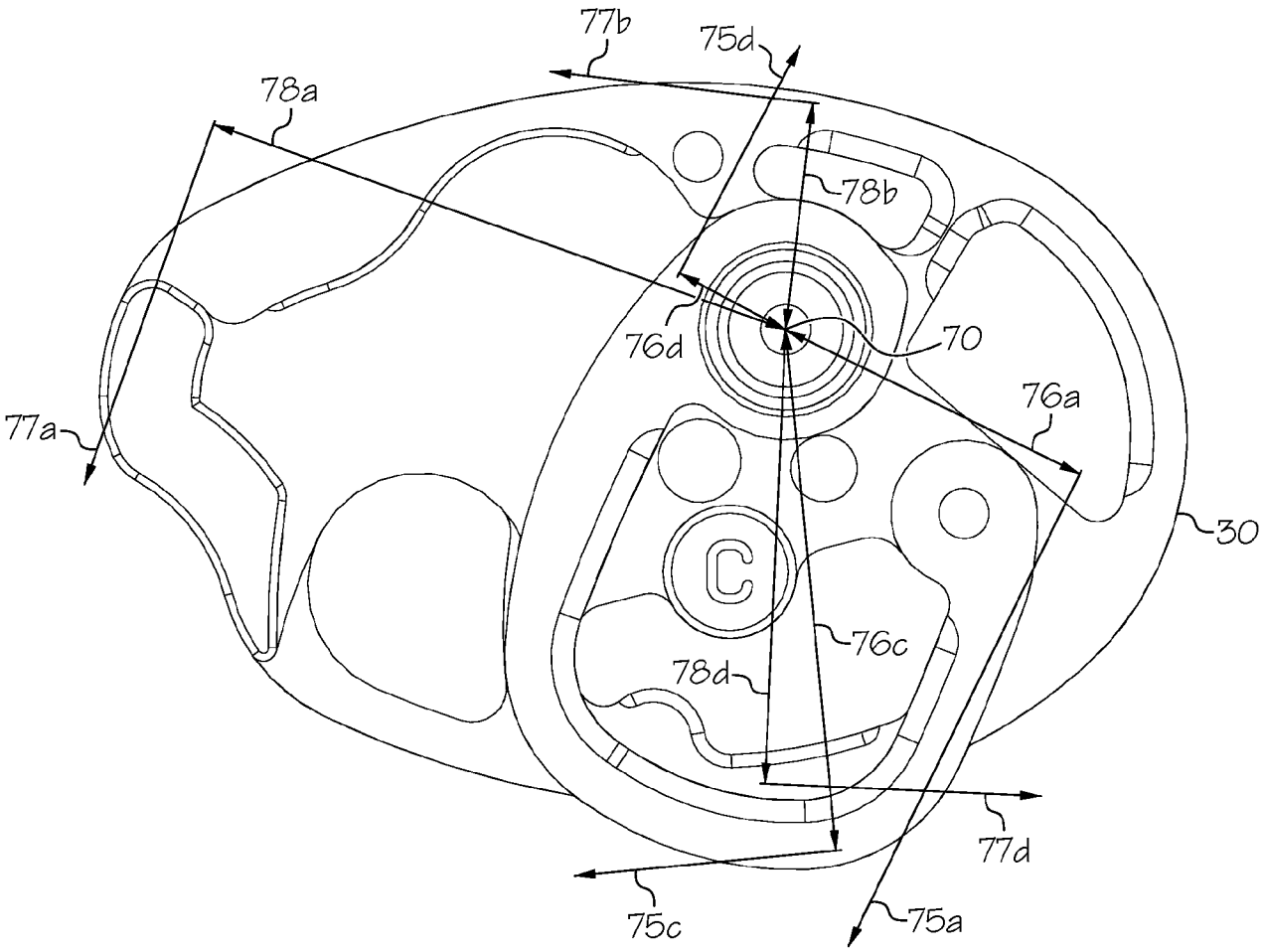
FIG. 10 shows a detail of a rotatable member and the forces applied thereto.

FIG. 10 shows an embodiment of a rotatable member 30 with several power cable force vectors 75 and bowstring force vectors 77 shown at different stages of draw. Corresponding power cable moment arms 76 and bowstring moment arms 78 are also shown.

In a first draw orientation, the bowstring provides a first bowstring force vector 77*a* that defines a first bowstring moment arm 78*a*, and the power cable provides a first power cable force vector 75*a* that defines a first power cable moment arm 76*a*.

In a second draw orientation, the bowstring provides a second bowstring force vector 77*b* that defines a second bowstring moment arm 78*b*. In some embodiments, the second bowstring moment arm 78*b* defines a minimum value for the range of bowstring moment arm distances provided by the crossbow 10. The power cable defines a second power cable force vector that is not illustrated.

In a third draw orientation, the power cable provides a third power cable force vector 75*c* that defines a third power cable moment arm 76*c*. In some embodiments, the third power cable moment arm 76*c* defines a maximum value for the range of power cable moment arm distances provided by the crossbow 10. The bowstring defines a third bowstring force vector that is not illustrated.

In a fourth draw orientation, the bowstring provides a fourth bowstring force vector 77*d* that defines a fourth bowstring moment arm 78*d*, and the power cable provides a fourth power cable force vector 75*d* that defines a fourth power cable moment arm 76*d*. In some embodiments, the fourth bowstring moment arm 78*d* provides a maximum value that the bowstring moment arm reaches subsequent to its minimum value reached in the second draw orientation. In some embodiments, the fourth power cable moment arm 76*d* provides a minimum value for the range of power cable moment arm distances provided by the crossbow 10.

The table below shows measurements taken from an embodiment of a crossbow. The Draw Length column shows movement of a bowstring's nocking point, for example as measured along a shooting axis. The Draw Weight column shows the force required to hold the bowstring at the indicated Draw Length.

| Draw Length (Inches) | Bow String Moment Arm 78 (inches) | Power Cable Moment Arm 76 (inches) | Cam Ratio String/Cable | Draw Weight (Pounds) |
|---|---|---|---|---|
| 0 | 2.602 | 1.36 | 1.913 | 0 |
| 1 | 2.11 | 1.245 | 1.695 | 14.5 |
| 2 | 1.899 | 1.316 | 1.443 | 32 |
| 3 | 1.275 | 1.452 | 0.878 | 59.3 |
| 4 | 0.891 | 1.494 | 0.596 | 100 |
| 5 | 0.943 | 1.656 | 0.569 | 136.4 |
| 6 | 1.043 | 1.514 | 0.689 | 151.45 |
| 7 | 1.323 | 1.483 | 0.892 | 155.9 |
| 8 | 1.566 | 1.406 | 1.114 | 153.7 |
| 9 | 1.772 | 1.379 | 1.285 | 153.4 |
| 10 | 1.765 | 1.116 | 1.582 | 152.2 |
| 11 | 1.772 | 1.007 | 1.760 | 151.4 |
| 12 | 1.85 | 0.823 | 2.248 | 139.9 |
| 13 | 1.952 | 0.687 | 2.841 | 107.3 |
| 14 | 2.35 | 0.482 | 4.876 | 71.9 |
| 15 | 2.797 | 0.272 | 10.283 | 30.2 |

The let-off provided by the crossbow 10 can be calculated using the following formula: (Peak Draw Weight-Draw Weight at Full Draw)/Peak Draw Weight.

Using the above table as an example, the peak draw weight is approximately 156 pounds (see 7 inch draw length), and the draw weight at full draw is approximately 30 pounds (see 15 inch draw length). The let-off provided by the crossbow is (156-30)/156=~80% let off.

A high let off, for example a let off of 75% or more, reduces the amount of force applied to a latch assembly that retains the bowstring in the drawn condition. A higher let off desirably improves longevity of the crossbow.

In some embodiments, the bowstring moment arm 78 reaches a minimum value during the draw cycle (e.g. in the second orientation), and the bowstring moment arm 78 increases in value subsequent to that orientation. In some embodiments, the bowstring moment arm 78 reaches maximum value at full draw (e.g. fourth orientation). In some embodiments, the bowstring moment arm 78 has a maximum value in the brace condition (e.g. first orientation); however, this value does not impact the let-off calculation, and the bowstring moment arm 78 measured early in the draw cycle (e.g. prior to the minimum value reached in the second orientation) can be disregarded. Desirably, at full draw, the bowstring moment arm 78 reaches its maximum value subsequent to passing through its minimum value.

In some embodiments, the bowstring moment arm 78 at full draw is four times the minimum bowstring moment arm 78, or greater. In some embodiments, the bowstring moment arm 78 at full draw is equal to or greater than 3 times the minimum bowstring moment arm 78. In some embodiments, the bowstring moment arm 78 at full draw is equal to or greater than 2.5 times the minimum bowstring moment arm 78. In some embodiments, the bowstring moment arm 78 at full draw is equal to or greater than 2 times the minimum bowstring moment arm 78. In some embodiments, the bowstring moment arm 78 at full draw is equal to or greater than 1.5 times the minimum bowstring moment arm 78.

In some embodiments, the power cable moment arm 76 reaches a maximum value during the draw cycle (e.g. third orientation) and a minimum value at full draw. In some embodiments, the power cable moment arm 76 maximum value is equal to or greater than seven times the minimum value. In some embodiments, the power cable moment arm 76 maximum value is equal to or greater than six times the minimum value. In some embodiments, the power cable moment arm 76 maximum value is equal to or greater than five times the minimum value. In some embodiments, the power cable moment arm 76 maximum value is equal to or greater than four times the minimum value.

In some embodiments, a crossbow 10 provides both the relative bowstring moment arm 78 minimum and maximum values described above, as well as the relative power cable moment arm maximum and minimum values described above.

The above table provides a ratio calculation of bowstring moment arm 78/power cable moment arm 76. In some embodiments, a ratio of the bowstring moment arm at full draw 78*d*/the power cable moment arm at full draw 76*d* is equal to or greater than 12. In some embodiments, a ratio of the bowstring moment arm at full draw 78*d*/the power cable moment arm at full draw 76*d* is equal to or greater than 11. In some embodiments, a ratio of the bowstring moment arm at full draw 78*d*/the power cable moment arm at full draw 76*d* is equal to or greater than 10. In some embodiments, a ratio of the bowstring moment arm at full draw 78*d*/the power cable moment arm at full draw 76*d* is equal to or greater than 9. In some embodiments, a ratio of the bowstring moment arm at full draw 78*d*/the power cable moment arm at full draw 76*d* is equal to or greater than 8.

Figure 11:
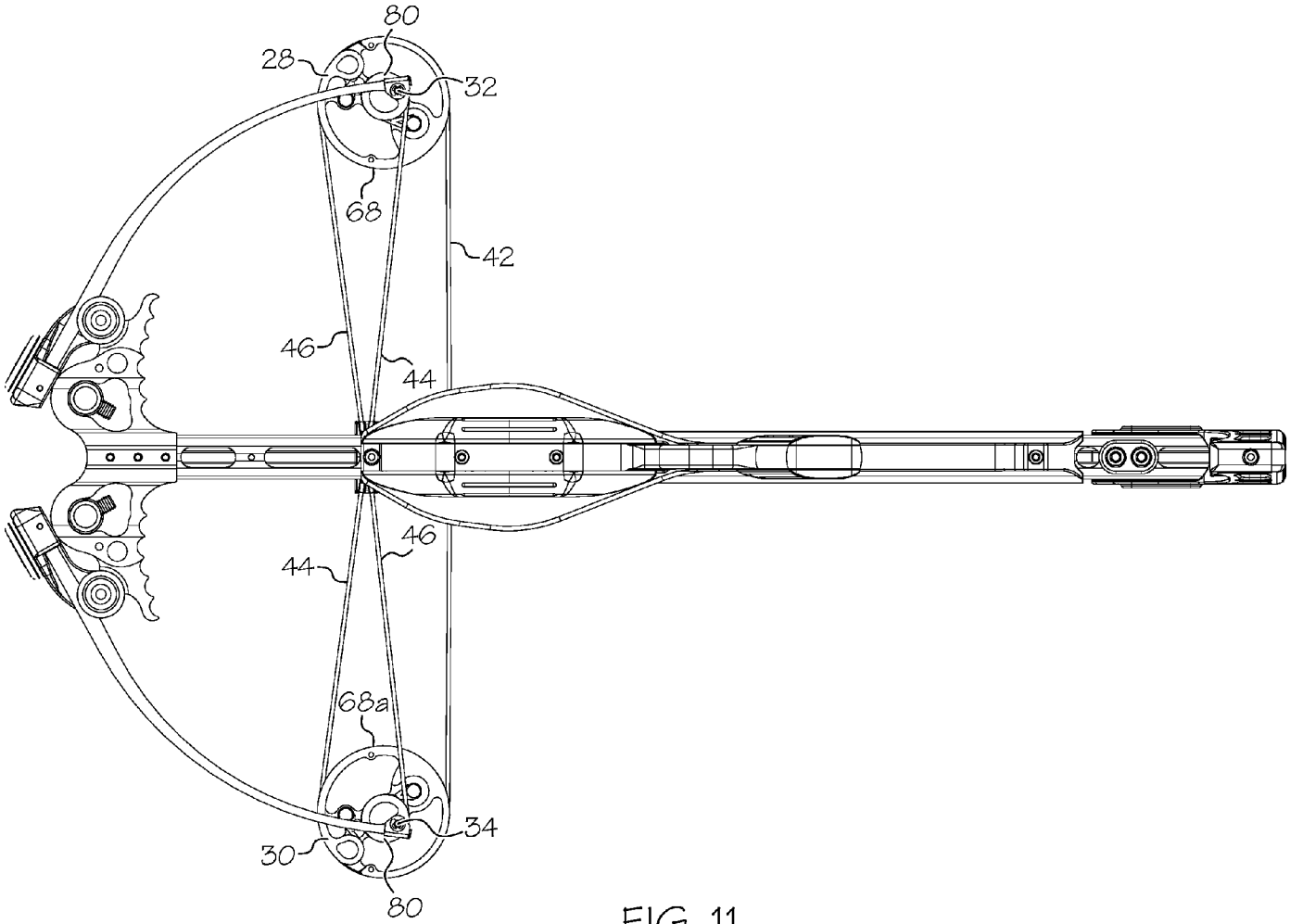
FIG. 11 shows an embodiment of a crossbow in a brace condition.

FIG. 11 shows another embodiment of a crossbow 10 in a brace condition. The crossbow 10 comprises rotatable members as described in U.S. Provisional Patent Application No. 62/085,208, filed Nov. 26, 2014, the entire disclosure of which is hereby incorporated herein by reference. A bowstring 42 extends between the rotatable members 28, 30. A first power cable 44 has a first end arranged for take up on a power cable take-up track 68 of a rotatable member 30 and has a second end arranged to feed out from a cable anchor feed-out track 80 of the other rotatable member 28. A second power cable 44 has a first end arranged for take up on a power cable take-up track 68 of a rotatable member 28 and has a second end arranged to feed out from a cable anchor feed-out track 80 of the other rotatable member 28.

Attaching the second ends of the power cables 44, 46 to the cable anchor feed-out tracks 80 provides synchronization between the rotatable members 28, 30. The synchronization provided helps to maintain the nocking point of the bowstring in alignment with the shooting axis of the crossbow 10. The synchronization helps prevent the nocking point from moving laterally, for example displacing in the lengthwise direction of the crossbow.

Figure 12:
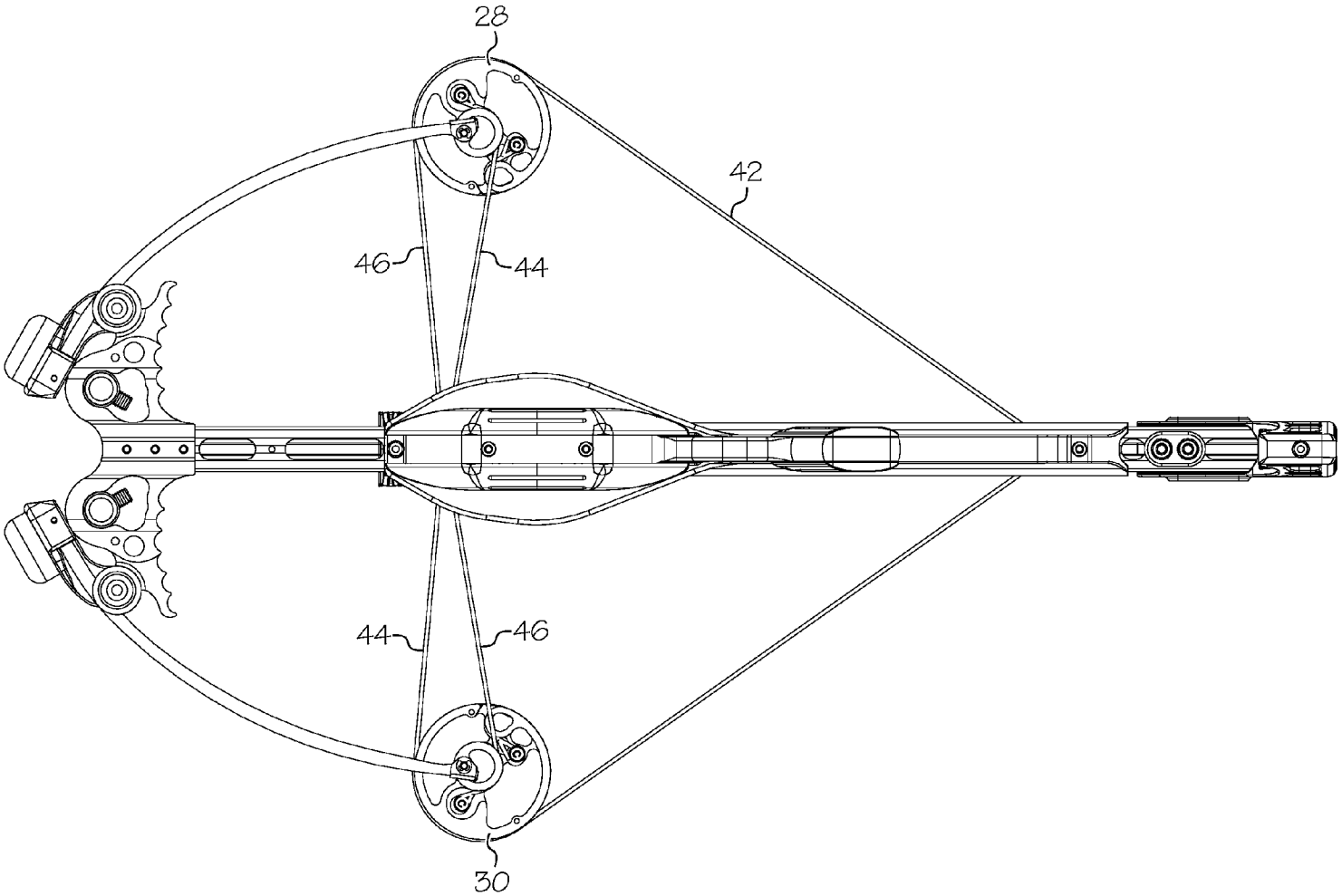
FIG. 12 shows the crossbow of FIG. 11 in a drawn condition.
Figure 13:
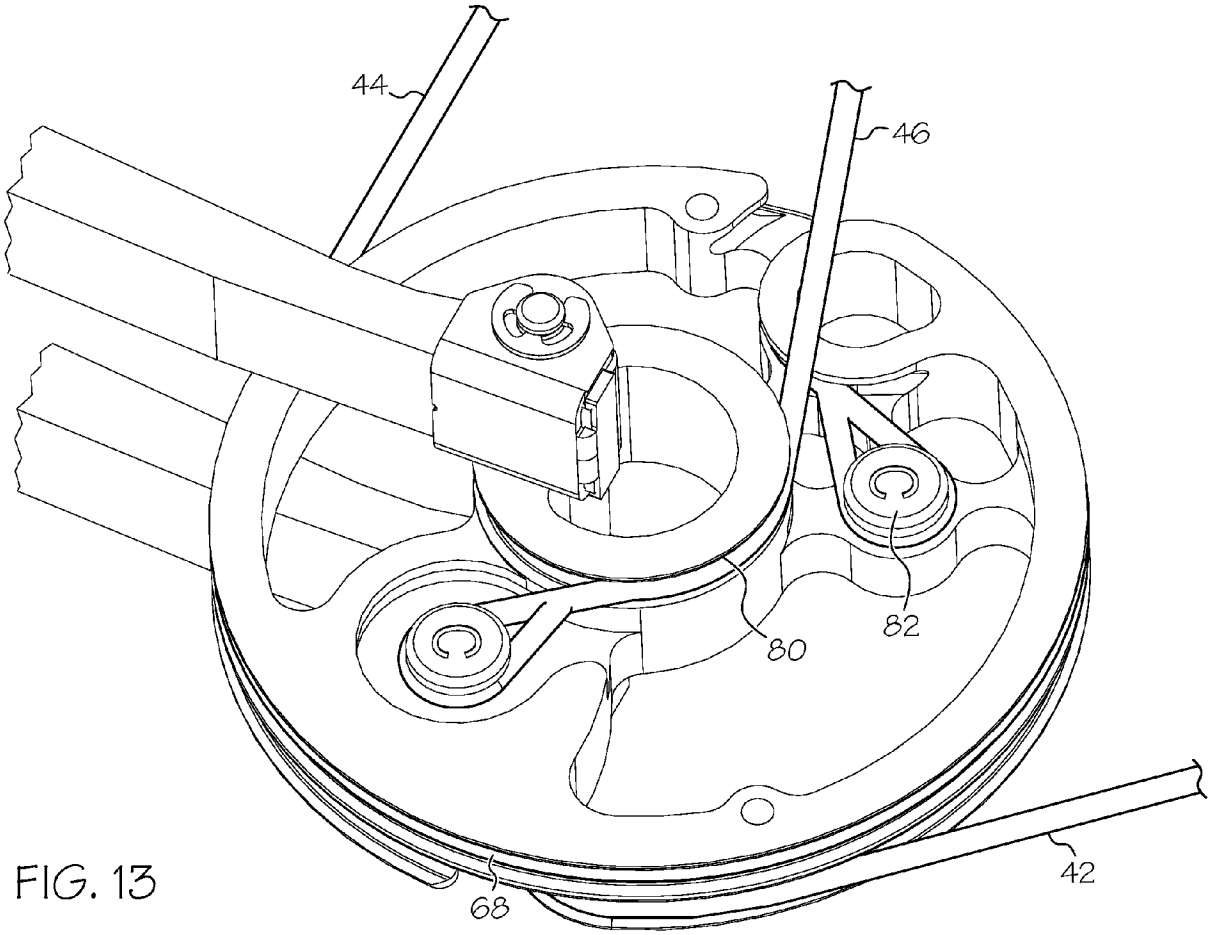
FIG. 13 shows a rotatable member of the crossbow of FIG. 12.

FIG. 12 shows the crossbow of FIG. 11 in a drawn condition. FIG. 13 shows a rotatable member 30 from FIG. 12 in greater detail, in an angled view so the cable tracks are more visible. The bowstring 42 has been fed out from the bowstring feed-out track. The first power cable 44 has been taken up on the power cable take-up track 68 and terminates on a terminal post 82. The second power cable 46 has been fed out from the cable anchor feed-out track 80.

Figure 14:
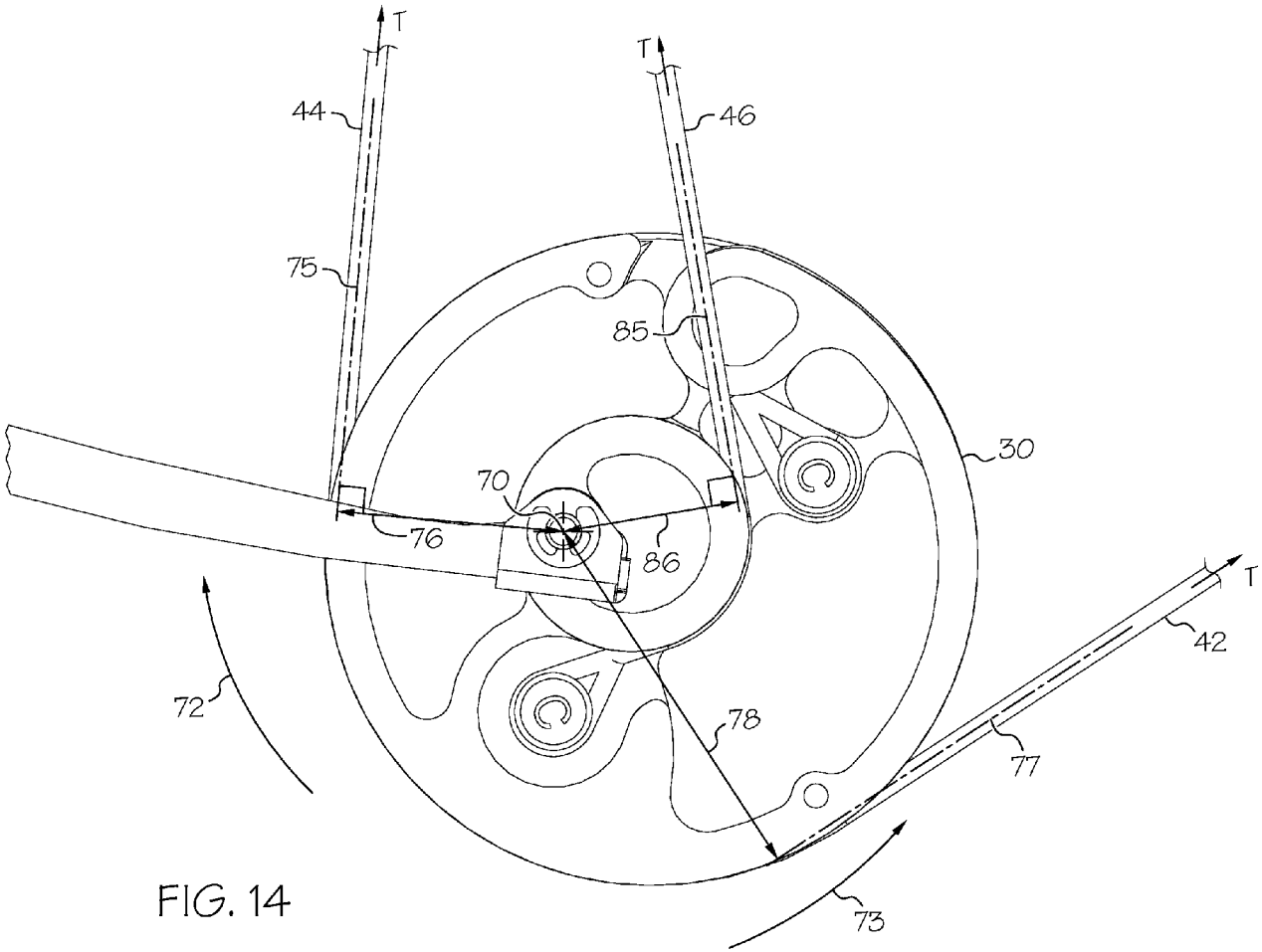
FIG. 14 shows the rotatable member of FIG. 13 and the forces applied thereto.

FIG. 14 shows a rotatable member 30 in the drawn condition, for the purpose of illustrating the rotating forces that are applied to the rotatable member 30 by the bowstring 42 and power cables 44, 46. Forces applied by the bowstring 42 and second power cable 46 work cooperatively, and in opposition to forces applied by the first power cable 44.

Tension T in the first power cable 44 applies a rotational force in a first rotational direction 72 (e.g. clockwise) about the center of rotation 70 of the rotatable member 30. The specific rotational moment applied by the first power cable 44 can be calculated using the magnitude of the tension T multiplied by the first power cable moment arm 76. The first power cable force vector 75 can be extended as necessary, and the first power cable moment arm 76 is oriented orthogonal to the power cable force vector 75. The power cable moment arm 76 extends to the center of rotation 70.

Tension T in the bowstring 42 applies a rotational force in a second rotational direction 73 (e.g. counter-clockwise) about the center of rotation 70 of the rotatable member 30. The specific rotational moment applied by the bowstring 42 can be calculated using the magnitude of the tension T multiplied by the bowstring moment arm 78. The bowstring force vector 77 can be extended as necessary, and the bowstring moment arm 78 is oriented orthogonal to the bowstring force vector 77. The bowstring moment arm 78 extends to the center of rotation 70.

Tension T in the second power cable 46 applies a rotational force in the second rotational direction 73 (e.g. counter-clockwise) about the center of rotation 70 of the rotatable member 30. The specific rotational moment applied by the second power cable 46 can be calculated using the magnitude of the tension T multiplied by the second power moment arm 78. The bowstring force vector 77 can be extended as necessary, and the bowstring moment arm 78 is oriented orthogonal to the bowstring force vector 77. The bowstring moment arm 78 extends to the center of rotation 70.

During the draw cycle, the bowstring moment arm 78, the first power cable moment arm 76 and the second power cable moment arm 86 (e.g. cable anchor moment arm) change in length. Desirably, the bowstring moment arm 78 reaches a minimum value at some point of the draw cycle then increases to a maximum value. Desirably, the first power cable moment art 76 reaches a maximum value and then reaches a minimum value during the draw cycle. Desirably, the second power cable moment arm 86 reaches a maximum value as the crossbow 10 is drawn.

Because the force applied by the second power cable 46 cooperates with the bowstring 42, the force applied by the second power cable 46 contributes to the let-off in draw force. In some embodiments, the second power cable moment arm 86 has a minimum value in the brace condition. In some embodiments, the second power cable moment arm 86 continually increases in value as the crossbow is drawn until reaching a maximum value at full draw.

In some embodiments, the bowstring moment arm 78 reaches a maximum value during the draw cycle and then decreases slightly at full draw. In some embodiments, the first power cable moment arm 76 reaches a minimum value during the draw cycle and then increases slightly at full draw.

Examples of crossbow devices may be found in U.S. Pat. No. 5,598,829; 61/733,897; U.S. Pat. Nos. 8,443,791; 7,946,281; 5,809,982; 6,035,840; 5,996,567; 6,039,035; 6,321,736; 8,402,960; 8,505,526; 6,247,466; 6,267,108; 61/734,193; Ser. Nos. 14/021,751; 14/021,655; 13/480,774; 13/835,783; U.S. Pat. Nos. 8,020,544; 8,453,635; 5,884,614; 4,693,228; 3,990,425; 4,337,749; 4,338,910; 4,440,142; 4,461,267; 4,515,142; 4,519,374; 4,660,536; 4,774,927; 4,926,833; 4,967,721; 5,211,155; 5,368,006; 5,381,777; 5,505,185; 5,678,529; 5,782,229; 5,791,323; 5,890,480; 5,934,265; 5,960,778; 6,082,347; 6,112,732; 6,443,139; 6,516,790; 6,666,202; 6,688,295; 6,792,930; 6,994,079; 7,047,958; 7,188,615; 7,305,979; 7,441,555; 6,382,201; 4,827,894; 5,025,771; 5,649,520; 6,257,219; 6,237,582; 6,990,970; 6,267,108 and U.S. Patent Publication Numbers 2008/0135032; 2010/0000504; and U.S. Patent Application Nos. 61/699,271; 61/699,244; 61/699,197; 61/699,248; Ser. Nos.

09/503,013; 09/502,149; 09/502,917; and 12/916,261 the entire contents all of which being incorporated herein by reference in their entireties.

In addition to the specific embodiments claimed below, the invention is also directed to other embodiments having any other possible combination of the dependent features claimed below.

It will be understood that this disclosure, in many respects, is only illustrative. Changes may be made in details, particularly in matters of shape, size, material, means of attachment, and arrangement of parts without exceeding the scope of the invention. Accordingly, the scope of the invention is as defined in the language of the appended Claims.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A crossbow comprising:

a stock, a first limb, a first rotatable member, a second limb and a second rotatable member;

the first rotatable member comprising a first track, a second track and a third track, the first track comprising a bowstring track, the second track comprising a power cable take-up track and the third track comprising a cable anchor feed-out track;

a bowstring extending between the first rotatable member and the second rotatable member; and a first power cable extending from said power cable take-up track of said first rotatable member to said second rotatable member;

a second power cable extending from said second rotatable member to said cable anchor feed-out track of said first rotatable member;

wherein the first rotatable member establishes a draw force left-off for the bowstring of at least 70% during draw of the bowstring from a brace position to a drawn position.

2. The crossbow according to claim 1, said first limb and said second limb each having a length dimension of approximately 12 inches.

3. The crossbow according to claim 1, said first rotatable member supported upon a first axle and said second rotatable member supported upon a second axle.

4. The crossbow according to claim 3, wherein an axle-to-axle separation distance between said first axle and said second axle in said brace position is less than 18 inches.

5. The crossbow according to claim 1, said bowstring applying a first rotational force to said first rotatable member having a bowstring moment arm, said first power cable applying a second rotational force to said first rotatable member having a first power cable moment arm, wherein said first power cable moment arm and said bowstring moment arm change as the crossbow is drawn.

6. The crossbow according to claim 5, wherein a length of said bowstring moment arm in a fully drawn position is at 3 times the minimum length of said bowstring moment arm during draw.

7. The crossbow according to claim 6, wherein a length of said bowstring moment arm in a fully drawn position is at 4 times the minimum length of said bowstring moment arm during draw.

8. The crossbow according to claim 6, wherein a maximum length of said first power cable moment arm during draw is equal to or greater than 4 times the length of said first power cable moment arm in the fully drawn condition.

9. The crossbow according to claim 5, wherein a maximum length of said first power cable moment arm during draw is equal to or greater than 4 times the length of said first power cable moment arm in the fully drawn condition.

10. The crossbow according to claim 5, wherein a ratio of said bowstring moment arm/said first power cable moment arm at full draw is equal to or greater than 8.

11. The crossbow according to claim 1, wherein said cable take-up track is substantially circular in shape and offset from a rotation axis of said first rotatable member.

12. The crossbow according to claim 11, wherein said bowstring track is substantially elliptical in shape.

13. A crossbow comprising:

a stock;

a first limb supporting a first rotatable member, said first rotatable member comprising a first track, a second track and a third track, the first track comprising a bowstring feed-out track, the second track comprising a power cable take-up track and the third track comprising a cable anchor feed-out track;

a second limb supporting a second rotatable member, said second rotatable member comprising a bowstring feed-out track, a power cable take-up track and a cable anchor feed-out track;

a bowstring extending between the first rotatable member and the second rotatable member in communication with said respective bowstring feed-out tracks; and a first power cable having a first end in communication with said power cable take-up track of said first rotatable member and a second end in communication with said cable anchor feed-out track of said second rotatable member;

a second power cable having a first end in communication with said power cable take-up track of said second rotatable member and a second end in communication with said cable anchor feed-out track of said first rotatable member;

wherein said first power cable applies a rotational force to said second rotatable member at said cable anchor feed-out track, said rotational force having a cable anchor moment arm that changes during draw, said cable anchor moment arm having a maximum value at full draw.

14. The crossbow of claim 13, wherein said bowstring exhibits a draw force let-off of at least 70%.

15. The crossbow of claim 13, wherein said bowstring exhibits a draw force let-off of at least 80%.

16. The crossbow of claim 13, said bowstring applying a bowstring rotational force to said second rotatable member having a bowstring moment arm, said second power cable applying a second power cable rotational force to said second rotatable member having a power cable moment arm, wherein a length of said bowstring moment arm in a fully drawn position is at 3 times a minimum length of said bowstring moment arm during draw.

17. The crossbow of claim 16, wherein a maximum length of said power cable moment arm during draw is equal to or greater than 4 times the length of said power cable moment arm in the fully drawn condition.

* * * * *